United States Patent [19]

Vertegaal

[11] 3,974,950

[45] Aug. 17, 1976

[54] APPARATUS FOR DEALING WITH HORIZONTAL BARS

[75] Inventor: Jacobus Gerardus Vertegaal, Boxmeer, Netherlands

[73] Assignee: Stork Brabant B.V., Boxmeer, Netherlands

[22] Filed: May 27, 1975

[21] Appl. No.: 580,998

[30] Foreign Application Priority Data

June 17, 1974 Netherlands ..... 7408087

[52] U.S. Cl. ..... 226/107

[51] Int. Cl.[2] ..... B65H 17/00

[58] Field of Search ..... 226/104–107; 34/157; 68/5 D

[56] References Cited

UNITED STATES PATENTS 1,582,457 4/1926 Ford ..... 226/107 X 3,770,174 11/1973 Koster ..... 226/107

*Primary Examiner*—Richard A. Schacher

*Attorney, Agent, or Firm*—Kaufman & Kramer

[57] ABSTRACT

A device for uncoupling and thereafter recoupling both ends of horizontally travelling bars to a conveyor consisting of two parallel chains. Each chain is provided with a great number of supporting means composed of an unmovable first member and a rotatable second member capable of receiving and temporarily retaining an end of a bar and of releasing said end again. The locking and unlocking of the end of the bar is rendered possible by a rotational movement of said second member caused by four stationary abutments along the path of the advancing conveyor chains.

3 Claims, 5 Drawing Figures

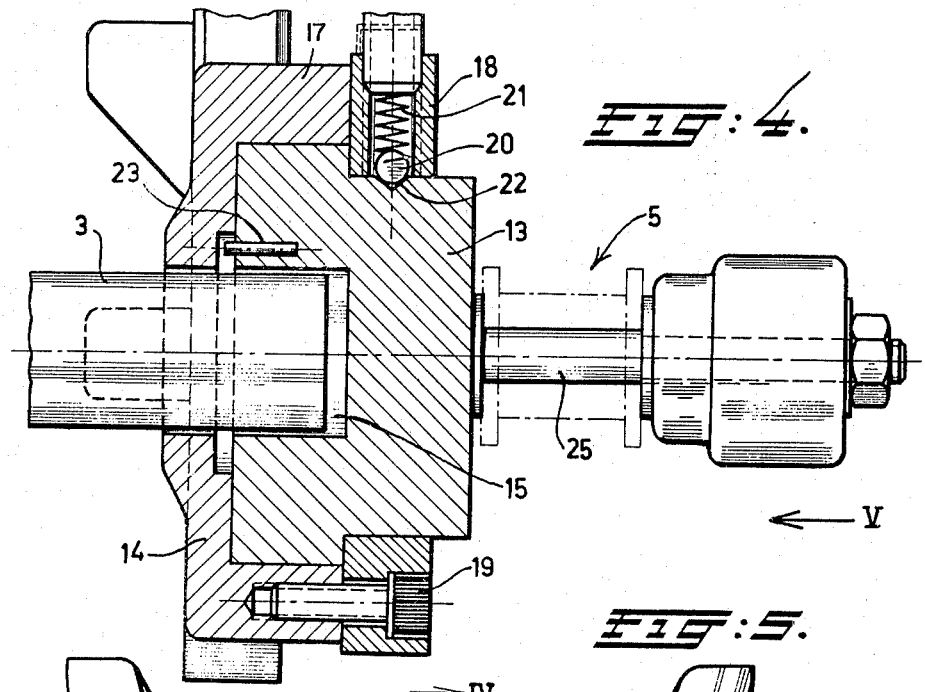
FIG: 4.
FIG: 5.
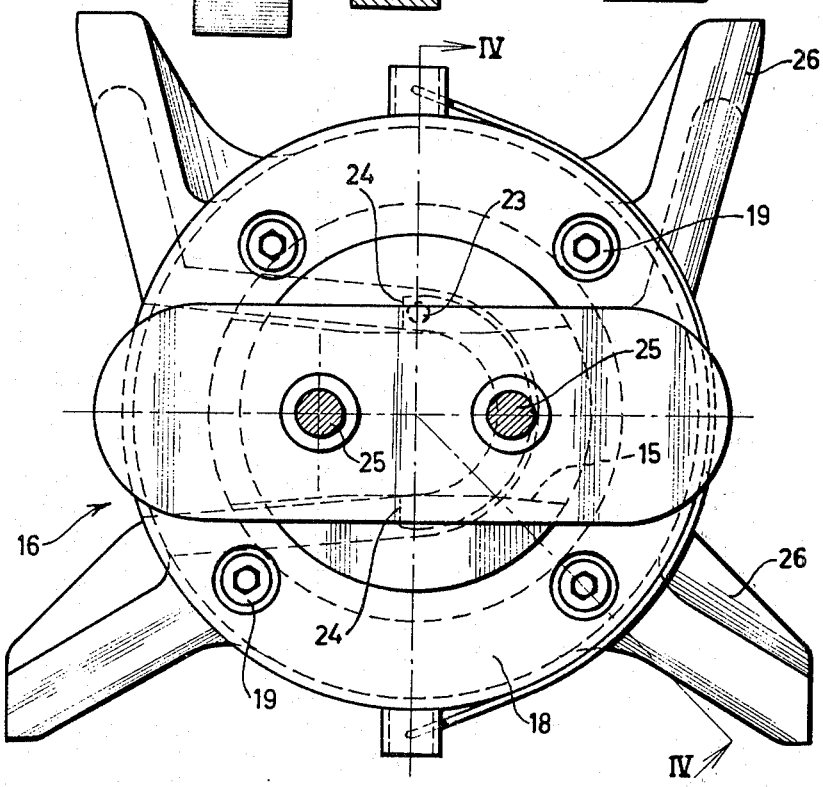

APPARATUS FOR DEALING WITH HORIZONTAL BARS

BACKGROUND OF THE INVENTION

The invention relates to a device for delivering and picking up again horizontal bars at two spaced locations, e.g. the beginning and the end of a horizontal guide of a steamer for a web of material which is suspended in loops, comprising two parallel conveyors each supporting an end of the bars and conveying same along a path from the end of the guide to the beginning thereof, the conveyors comprising supporting means for retaining or releasing the ends of the bars, and the conveyor path containing abutments, arranged for adjusting a movable part of the supporting means.

DISCUSSION OF THE PRIOR ART

U.S. Pat. No. 3,770,174 discloses a device in which the means for retaining or releasing the ends of the bars consist of pins slidable to and fro which are coupled to shoes sliding along stationary arranged cam surfaces. Although this known device operates satisfactorily, there is a need for a simpler construction of both the supporting means in the conveyors in which the ends of the bars are received and of the cam surfaces or stationary abutments for periodically releasing or locking the ends of the bars.

SUMMARY OF THE INVENTION

According to the present invention the supporting means for each rod consist of at least two members: viz. a first member, secured to each conveyor and provided with a groove which extends at least from the centre to the outside of the member and which is wide enough to allow the passage of an end of a bar and a second member, movably connected with each conveyor and provided with a U-shaped opening which in a particular position of this member coincides with the groove of the stationary member.

Due to these features it is possible to confine the ends of each bar periodically on all sides between the two walls of the groove on the one hand and the two legs of the U-shaped opening on the other hand, the bar not being clamped under this condition and therefore being capable of performing an eventual rolling movement on the horizontal guide. The movable member can easily be turned through 90° by providing the same with one or more projections capable of cooperation with stationary abutments of a very simple construction along the path of the conveyors. Other means may, however, also be conceived for pivoting the movable member.

According to an embodiment the groove in the stationary member is diametrically directed, parallel to the conveyors in their stretched condition. In this embodiment the bars can be effectively lifted from the conveyor so as to deliver them to the horizontal guide. The bars can also be more easily picked up again in the conveyors.

SURVEY OF THE DRAWINGS

FIG. 4 is an axial section of the supporting means.

FIG. 5 is a front view of the supporting means.

DESCRIPTION OF A PREFERRED EMBODIMENT

Figure 1:
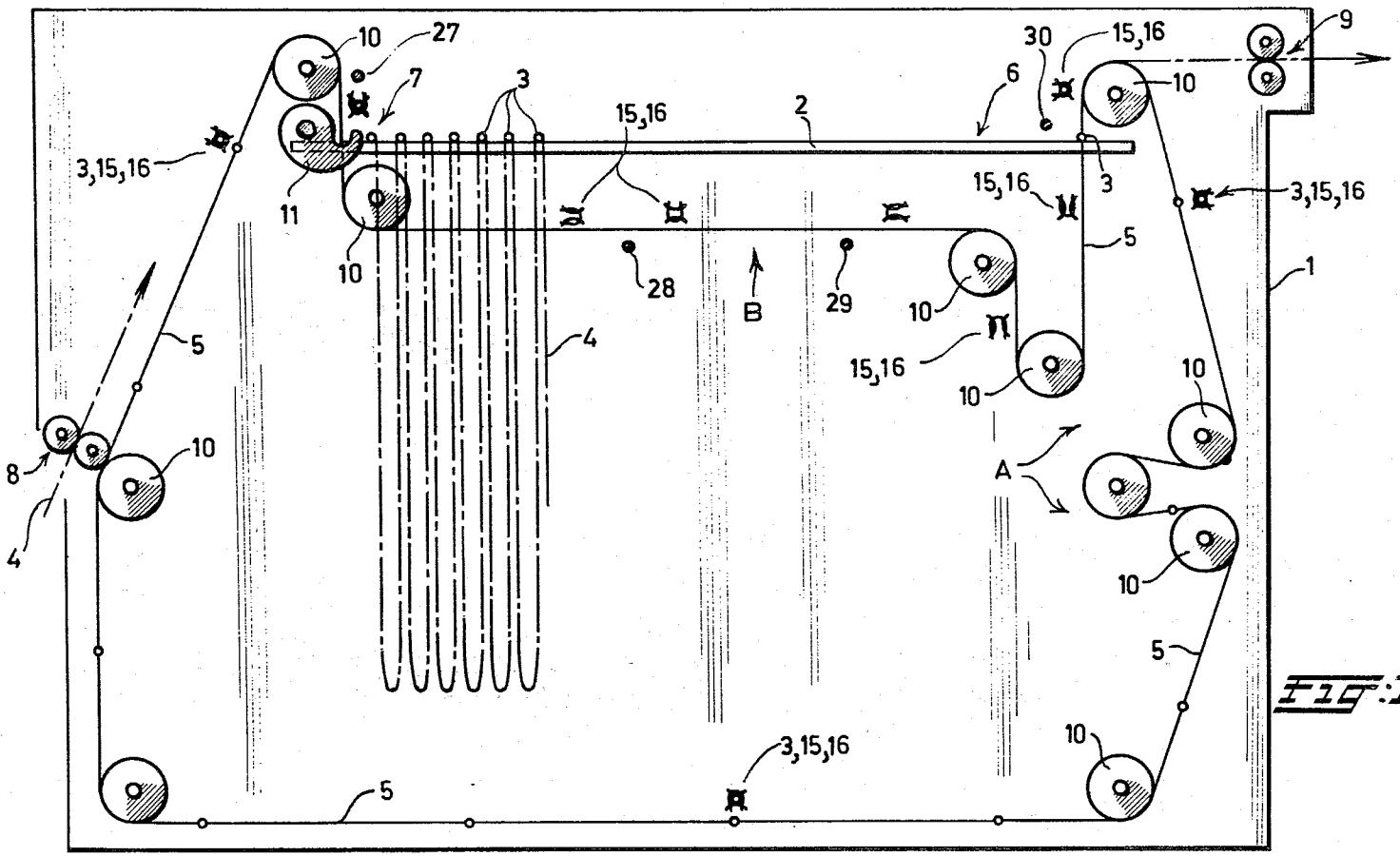
FIG. 1 shows diagrammatically a front view of the device.
Figure 2:
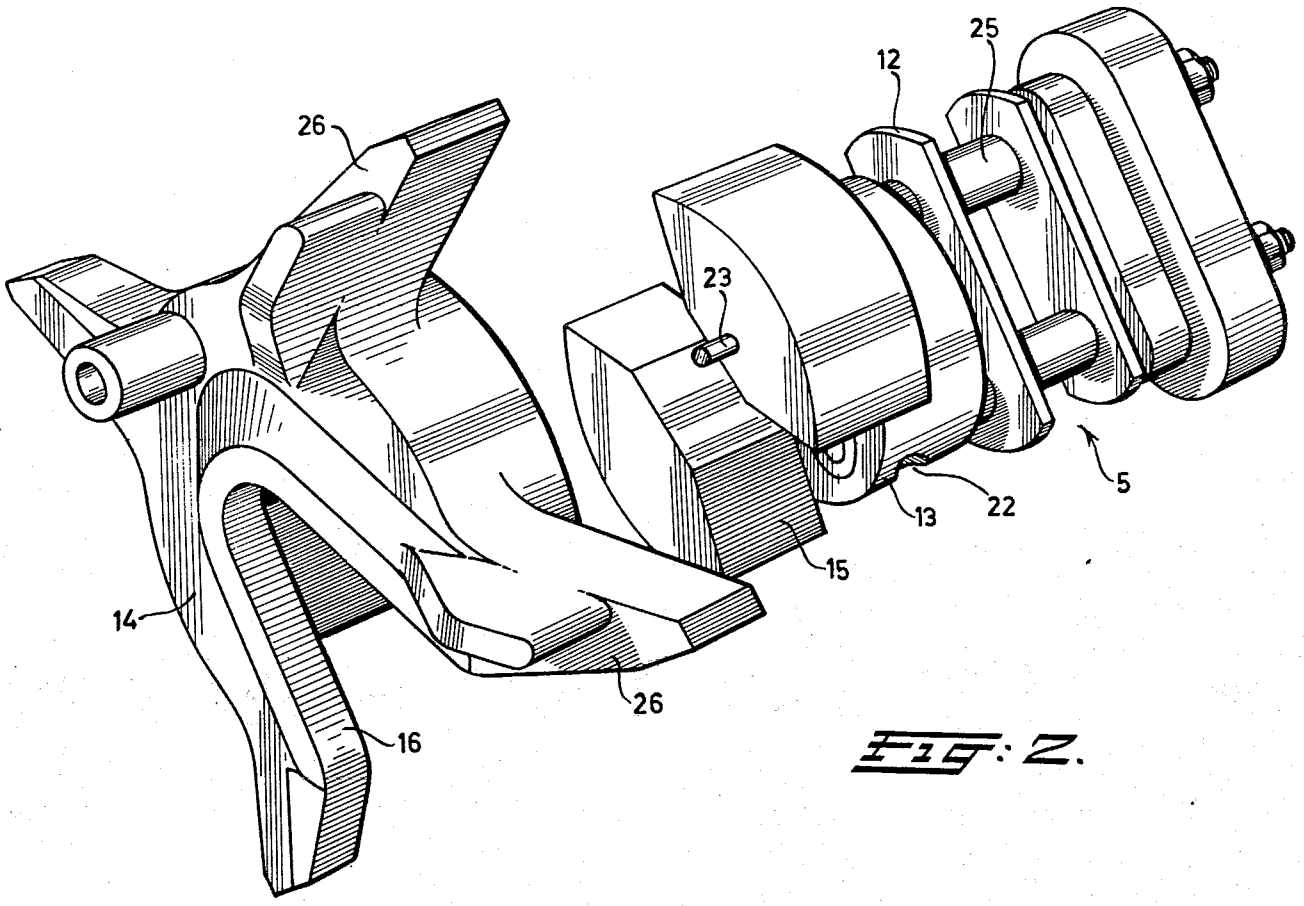
FIG. 2 is an exploded perspective view of the supporting means as viewed from the conveyor.
Figure 3:
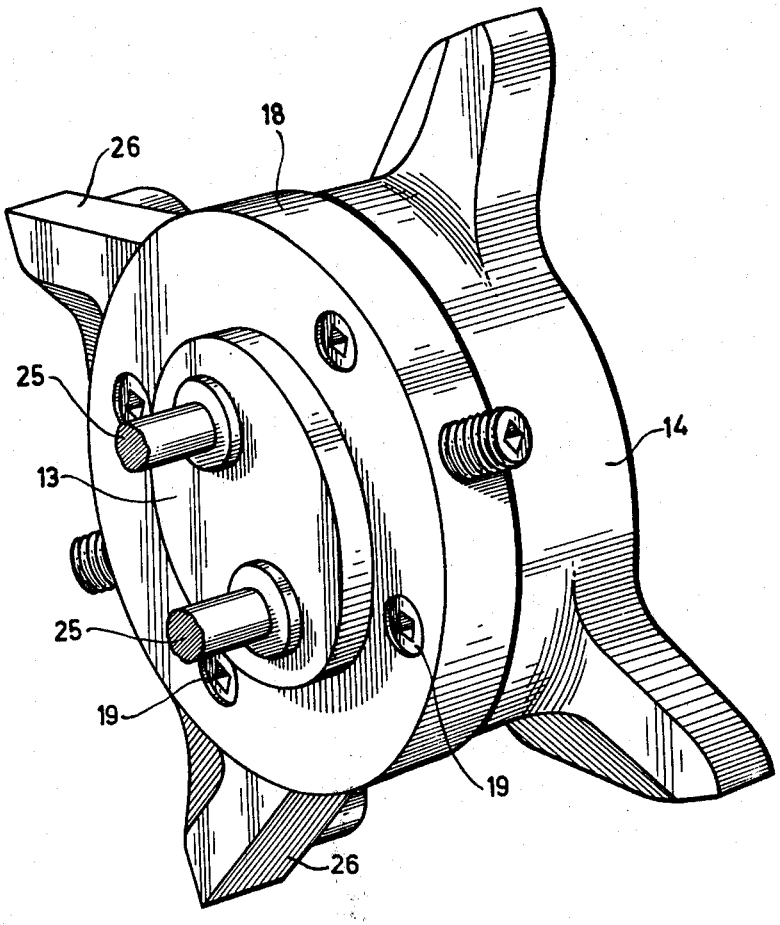
FIG. 3 is a perspective view of the supporting means looking toward the conveyor.

As is seen in FIG. 1 the device corresponds roughly with the one described in the aforementioned U.S. Pat. No. 3,770,174. Within a housing 1 a horizontal guide 2 is mounted along which a plurality of bars 3 are advanced. A web of material 4 is slung such about these rods that each rod 3 carries a long suspended loop of this material 4. Within the housing 1 two parallel conveyors 5 are further provided each supporting one end of the bars and conveying the latter along a path from the end 6 of the guide 2 towards the beginning 7 of this guide. As is known from the aforementioned prior patent the web 4 is subjected to a steaming treatment during its travel through the housing 1. Web 4 enters housing 1 via a passage 8, while the treated web leaves housing 1 again through an exit 9. The path of the conveyors 5 is determined by a plurality of guide wheels 10 provided within housing 1, one or more of which are driven for advancing the conveyors. At the beginning 7 of guide 2 a rotary cam 11 is arranged, the effect of which is described in detail in another prior U.S. Pat. No. 3,774,830.

Details of the device according to FIG. 1 are shown in FIGS. 2 to 5, these details being essential with respect to this invention. In the two conveyors 5 which consist of chains with links 12, supporting means for retaining or releasing the ends of the bars 3 are mounted. These means are constructed of at least two members, that is: a first member 13 secured to each conveyor 5 and a second member 14 movably connected with each conveyor. The fixedly connected member 13 is provided with a groove 15 which is diametrically directed parallel to the conveyor 5 in its stretched condition. This groove 15 is wide enough for allowing the passage of the end of a bar and diverges towards its ends for an easy inlet of an end of a bar.

The movable member 14 is provided with a U-shaped opening 16 and with an annular flange 17 engaging about the fixed member 13. Furthermore a fastening ring 18 is connected by four bolts 19 with the movable member 14 in such a manner that rotation of the member 14 relative to the stationary element 13 remains possible. Two balls 20 pressed by a spring 21 ensure some resistance to this pivotal movement, while in the intermediate positions aimed at the member 14, the balls cooperate with a recess 22 in member 13, in order to achieve a slight locking effect.

Rotation of the movable member 14 relative to the fixed member 13 is limited to 180° due to an extension 23 on member 13, which can cooperate with a groove delimited by two abutment faces 24 in member 14. This groove is also useful for preventing any faults during assembling the members 13 and 14. FIGS. 4 and 5 show that in one end position the U-shaped opening 16 of member 14 coincides with groove 15 of the fixed member 13. Under these circumstances an end of a bar 3 can be slid in or out. After rotation through 90° member 14 is non-clampingly confined in the end of the bar. When member 14 is further rotated though 90°, then opening 16 is positioned again in line with groove 15, so that the confined bar end can move out and another bar end can move in, respectively. Members 13 and 14 which are jointly connected via two bolts 25 with the conveyor 5 constitute the supporting means for a bar 3 so that these bars can be conveyed from the end 6 of guide 2 along their path within housing 1 via entry 8 for web 4 to the beginning 7 of guide 2.

In the embodiment as shown, each movable member 14 is provided with four projections 26 which are staggered through approximately 90° relative to each other and which can cooperate with fixed abutments 27-30 within housing 1. For instance the first abutment 27 is situated before the beginning of guide 2 whereas the last abutment 30 is positioned beyond the end 6 of the guide, while two other abutments 28, 29 are lying in the "empty" path part B of the conveyors 5. In path A the ends of bars 3 are confined within the supporting means 13, 14. After reaching the first abutment 27, member 14 is turned through 90°. Conveyor 5 is in a vertical position and groove 15 and opening 16 which are parallel to each other, are likewise vertical, opening 16 being directed upwardly. On passing guide 2 bar 3 is received, this also being due to cam 11. The conveyors 5 cover subsequently the path part B without any bar 3. In this part, member 14 is turned by the two abutments 28 and 29 twice through 90°, so that opening 16 is again parallel to groove 15. The position of groove 15 and opening 16 is diagrammatically represented in FIG. 1 at various locations along parts A and B of the conveyors path. In the vicinity of the end 6 of guide 2 the conveyors 5 move vertically upwardly and at that location a bar 3 is picked up and carried along in an upward direction. The fourth abutment 30 lying in that neighbourhood turns member 14 back again through 90°, so that the ends of the bar are confined.

The conveyors can subsequently cover the whole track A while carrying along bars 3. After web 4 has passed the entry 8, loops are formed therein in conformity with the operation as described in the prior U.S. Pat. Nos. 3,770,174, 3,826,417 and 3,774,830. Consequently each bar 3 will carry a long downwardly directed loop of web 4 of material, the loops shoving consecutively beside each other along guide 2 in the direction of the end 6.

The advantages of the supporting means 13, 14 as described hereinbefore can be summarized as follows:

The new structure is simple and easier to manufacture. The new structure is more reliable due to the use of rotatable parts instead of slidable members.

What we claim is:

1. A device for delivering and picking up horizontal bars at spaced locations spanned by two parallel conveyors each supporting an end of each bar and conveying same along a path between the locations, the conveyors comprising supporting means for retaining or releasing the ends of the bars, said supporting means including a first member secured to each conveyor and provided with a groove which extends at least from the centre to the outside of the member and which is wide enough to allow the passage of an end of a bar, and a second member movably connected with each conveyor and provided with a U-shaped opening which in a particular position coincides with the groove of the stationary member, the conveyor path containing abutments arranged for adjusting said second member of the supporting means.

2. A device according to claim 1 wherein the groove in the first member is parallel to the conveyors in their stretched condition.

3. A device according to claim 2 in which the second member is provided with an annular flange engaging the first member, while one member is provided with an extension adapted to cooperate with two abutment faces in the other member for limiting the rotation of the second member to 180°.

* * * * *